US007298861B2

(12) United States Patent
Ermens

(10) Patent No.: US 7,298,861 B2
(45) Date of Patent: Nov. 20, 2007

(54) LOUDSPEAKER

(75) Inventor: Annick Simonne Irene Ermens, Dendermonde (BE)

(73) Assignee: PSS Belgium N.V., Dendermonde (BE)

( * ) Notice: Subject to any disclaimer, the term of this patent is extended or adjusted under 35 U.S.C. 154(b) by 0 days.

(21) Appl. No.: 10/541,989

(22) PCT Filed: Dec. 8, 2003

(86) PCT No.: PCT/IB03/06222

§ 371 (c)(1),
(2), (4) Date: Jul. 11, 2005

(87) PCT Pub. No.: WO2004/064448

PCT Pub. Date: Jul. 29, 2004

(65) Prior Publication Data

US 2006/0098837 A1 May 11, 2006

(30) Foreign Application Priority Data

Jan. 14, 2003 (EP) ..... 03100057

(51) Int. Cl.
*H04R 25/00* (2006.01)

(52) U.S. Cl. ..... 381/386; 381/432; 381/433

(58) Field of Classification Search ..... 381/86, 381/87, 386, 389, 392, 395, 396, 398, 189, 381/432, 433, 387, 345; 181/171, 172, 199
See application file for complete search history.

(56) References Cited

U.S. PATENT DOCUMENTS 4,889,208 A * 12/1989 Sugihara ..... 181/148
5,111,510 A * 5/1992 Mitobe ..... 381/398

FOREIGN PATENT DOCUMENTS

EP 0 510 345 B1 9/1996

* cited by examiner

*Primary Examiner*—Huyen Le
(74) *Attorney, Agent, or Firm*—Peter A. Nieves; Sheehan, Phinney, Bass + Green, P.A.

(57) ABSTRACT

A loudspeaker includes a housing with front and rear sides, a diagram flexibly connected to the housing, and an actuator or displacing the diaphragm with respect to the housing along a translation axis. The housing extends around the translation axis and includes a conical forepart widening towards the forepart, a base part positioned at the rear side, and an intermediate housing part. The intermediate part extends between the forepart and the base part and includes transition areas connected to these parts. The transitions behave as hinges under the influence of an axial load above a certain value, whereby the intermediate housing portion turns towards the translation axis and the forepart turns towards the rear side under the influence of such a load.

15 Claims, 3 Drawing Sheets

LOUDSPEAKER

Figure 1:
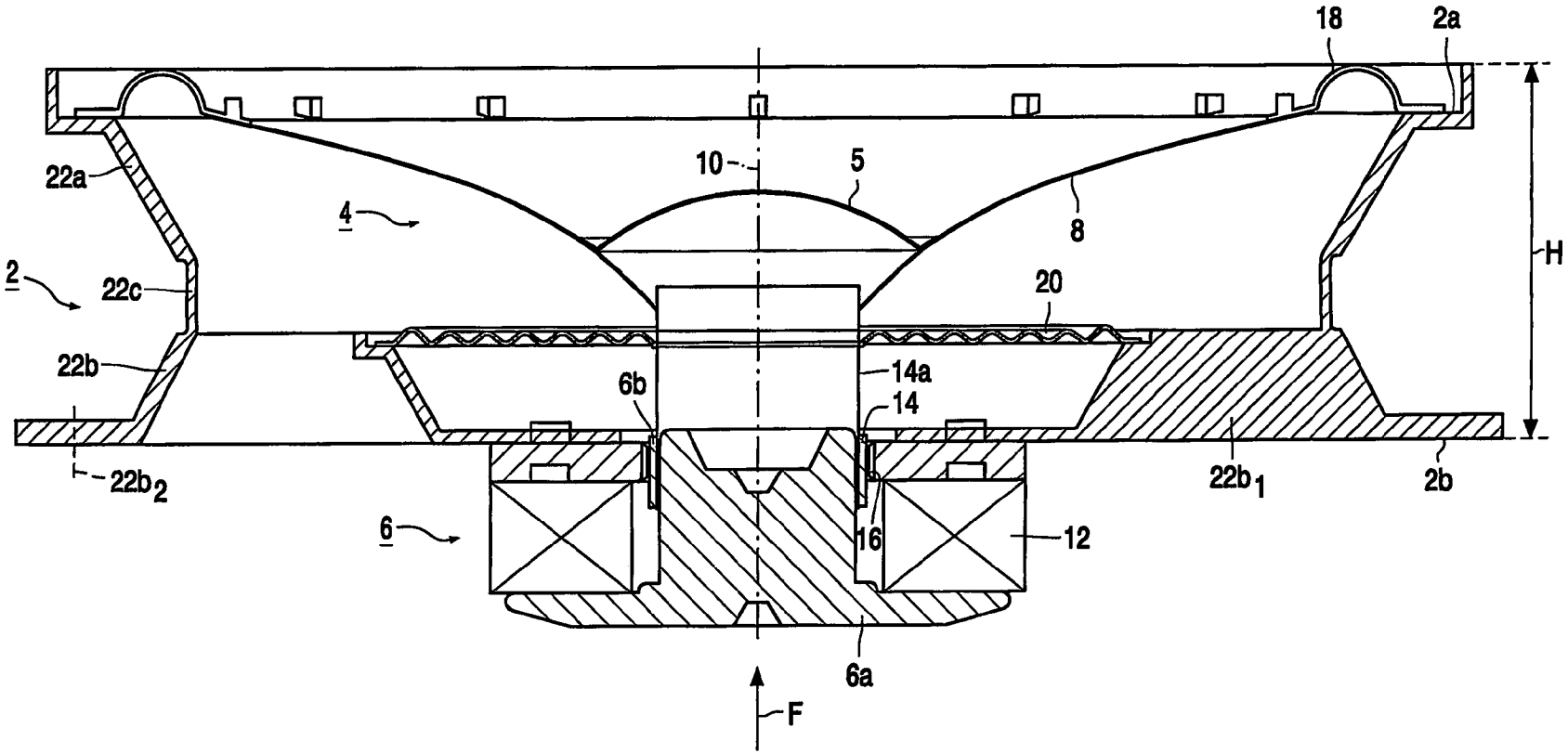

The invention relates to a loudspeaker, particularly intended for use in a motor vehicle, which loudspeaker includes a housing with a front side and a rear side, a diaphragm accommodated in the housing and flexibly connected to the housing, and an actuator for displacing the diaphragm with respect to the housing along a translation axis imaginarily extending from said one side to said other side of the housing, the housing extending around the translation axis.

Patent specification EP 0 510 345 B1 discloses a loudspeaker for use in motor vehicles. The known loudspeaker comprises a conical housing, a conical frame movably supported by the housing and an electromagnetic actuator. The conical frame, at one end of which the magnet system is permanently arranged, has a predetermined breaking point which is dimensioned in such a way that it should rupture beyond a predetermined force acting on the magnet system, and the part of the frame to which the magnet system is attached should decouple from the other part of the frame. In an alternative embodiment, the conical frame of the known loudspeaker has a continuous predetermined rupture zone which, in the event of a force acting on the magnet system, should ensure that the frame telescopes concertina-fashion in the determined rupture zone.

As is generally known, safety aspects are becoming more and more important for vehicles. In this context, it can be stated that all components in a car, and thus also built-in loudspeakers, may injure the driver and passengers, if any, in the event of a crash or collision. As the number of loudspeakers mounted in a car is still ever-increasing and more and more loudspeakers in cars are positioned in the direct vicinity of the occupants, loudspeakers play an essential role in meeting current safety requirements imposed on vehicles. It has appeared that rupture points and zones applied in the conical frame of the known loudspeaker are not very reliable when it comes to meeting the above-mentioned safety requirements.

It is an object of the invention to improve the loudspeaker of the kind as defined in the preamble in such a way that it conforms to the current safety requirements imposed on speakers mounted in a motor vehicle.

According to the invention, this object is achieved with the loudspeaker which includes a housing with a front side and a rear side, a diaphragm accommodated in and flexibly connected to the housing and an actuator for displacing the diaphragm with respect to the housing along a translation axis imaginarily extending from said one side to said other side of the housing, wherein the housing extends around the translation axis and is provided with a conical forepart widening towards the front side, a base part extending towards the rear side and an intermediate housing part extending between the forepart and the base part and including transition areas connected to the forepart and the base part, which transition areas behave as hinges under the influence of an axial load above a certain value, whereby the intermediate housing portion turns towards the translation axis and the forepart turns towards the rear side under the influence of such a load. If an axial force of a certain minimum value is exerted at the front side and/or the rear side of the housing, the transition areas of the intermediate housing part deform in such a way that the intermediate housing part turns inwardly, resulting in a shortening of the housing and thus of the loudspeaker as such. If desired, the transition areas can be designed in such a way that they break after a certain bending. The mentioned axial force or load may of course also be a component of a force or load, respectively, exerted under an angle, with regard to said sides.

The actuator applied in the loudspeaker according to the invention is usually an electromagnetic actuator which is known per se. Such an actuator has a magnet system attached to the housing, particularly the base part thereof, and a so-called voice coil fixed to the diaphragm. In such a device, the housing and the magnet system are generally the most dangerous components of loudspeakers built into a vehicle, in the case of an accident.

The loudspeaker according to the invention is able to conform to contradictory requirements, viz. the requirement that it is not allowed that the magnet system comes loose from the housing and the requirement that, if during a crash or collision the loudspeaker is pressed against a human body, it is not allowed that a predetermined maximal force exerted on the human body is exceeded. It has appeared that the housing of the loudspeaker according to the invention is solid enough to prevent a disconnection of the magnet system and is weak enough to absorb sufficient energy by plastic deformation, if necessary.

In a practical embodiment of the loudspeaker according to the invention, the intermediate housing has a substantially cylindrical shape. The transition areas may have another shape, and may be e.g. curved or S-shaped.

It is not necessary that the housing of the loudspeaker according to the invention is made of only one material. Usual materials for housing are e.g. polycarbonate and ABS (acrylnitril-butadien-styrol copolymer). By making the transition areas of another material, specific properties, such as e.g. a springback function, can be given to these areas. The housing can be manufactured by e.g. injection molding. Apart from the above-mentioned materials, suitable materials for the intermediate part are e.g. thermoplastic polyester elastomers and thermoplastic rubbers.

Alternatively, the transition areas can be formed from separate sheet materials such as rubber, rubber-plastic compounds, plastics and steel. For the above-mentioned reasons, the material of the intermediate housing part of a preferred embodiment is different from the material of the forepart and/or the base part.

Another practical embodiment has the feature that the transition areas are weaker than the other portions of the housing.

It has been proved that the following features are preferred. The forepart of the housing has an angle of inclination, related to a line parallel to the translation axis, which is at least 30 degrees. A suitable maximum value of the angle is 60 degrees. The intermediate housing part has a length dimension, viewed along a line parallel to the translation axis, which is at least 3 mm. The intermediate housing part preferably has a thickness dimension, viewed in a direction perpendicular to the translation axis, which is minimally 0.5 mm. As a rule, the thickness of the intermediate part is about 50% of the thickness of the other mentioned parts of the housing.

The invention also relates to a housing for use in the loudspeaker according to the invention. The housing according to the invention is constructed and structured as described elsewhere in this document.

It is noted in relation to the set of claims that various combinations of characteristic features defined in the claims are possible.

The above-mentioned and other aspects of the invention are apparent from and will be elucidated, by way of non-limitative examples, with reference to the embodiments described hereinafter.

Figure 2:
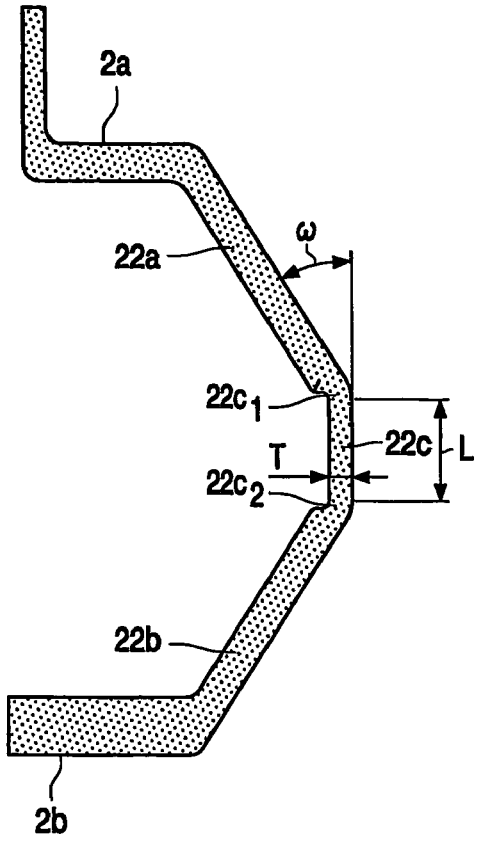
Figure 3:
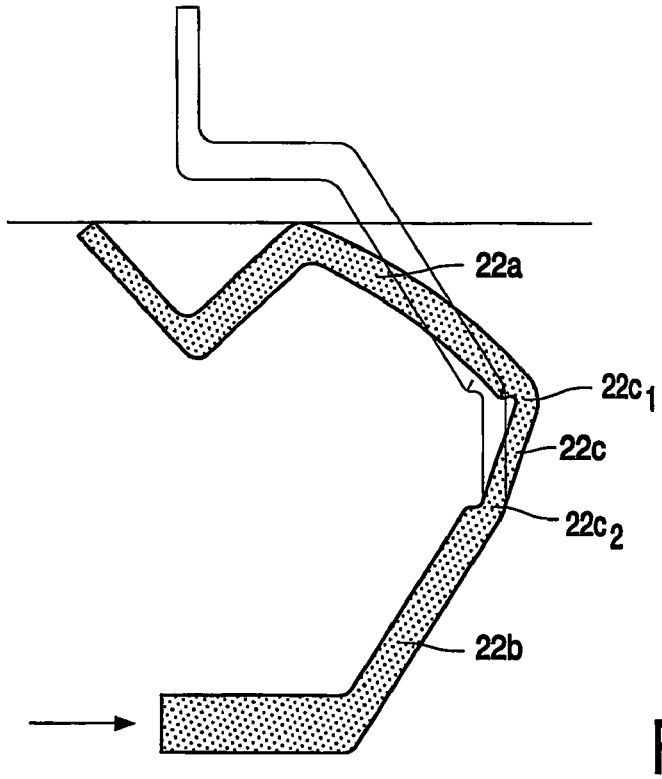
Figure 4:
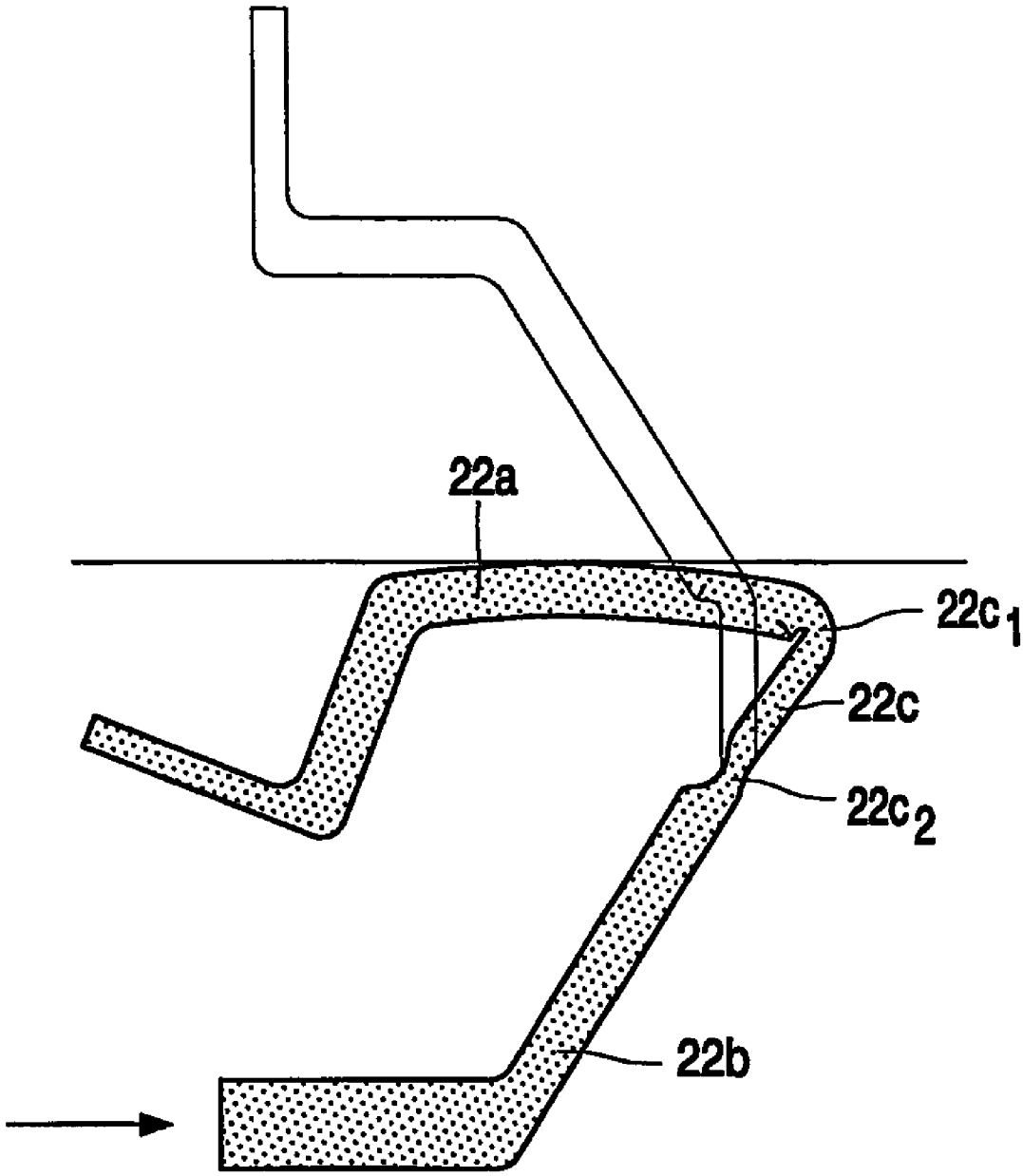

In the drawings:

FIG. 1 shows an embodiment of the loudspeaker according to the invention in a diagrammatic cross-section, FIG. 2 shows, in a cross-section, an essential part of the housing of the embodiment shown in FIG. 1, FIG. 3 shows, in a cross-section, the above-mentioned essential part after a small deformation of the housing as shown in FIG. 2, FIG. 4 shows, in a cross-section, the essential part after a large deformation.

The electrodynamic loudspeaker according to the invention, shown in FIG. 1, comprises a housing 2, a translatable body 4 and an electromagnetic actuator 6. The loudspeaker has a height H and is shielded by a dust cover 5. The housing 2, which is made of ABS in this example, has a front side 2*a* and a rear side 2*b*. The housing 2 may have a more or less closed contour or may be in the form of a more open frame. The translatable body 4 comprises a three-dimensional diaphragm 8, which is situated or at least extends in the housing 2. The function of the electromagnetic actuator 6 is to displace the body 4, and thus the diaphragm 8, along a translation axis 10, being the central axis of the loudspeaker, extending from the front side 2*a* to the rear side 2*b*, or vice versa. The actuator 6 essentially comprises two elements, namely a stationary actuator element 6*a* which is fixed to the housing 2, and a translatable actuator element 6*b* which is attached to the translatable body 4. The stationary element 6*a* is provided with a magnet system having an annular permanent magnet 12, and the other actuator element 6*b* is provided with a coil system having at least one magnet coil 14. When energizing the coil 14, both actuator elements 6*a*, 6*b* magnetically co-operate with each other over an air gap 16 for generating a driving force on the translatable body 4 parallel to the translation axis 20 and hence on the diaphragm 8 forming part thereof. Said magnet system also has soft iron parts which, together with the permanent magnet 12, form a magnetic yoke defining the air gap 16. The magnet coil 14, being a cylindrical coil, also referred to as voice coil, is situated on a coil support 14*a* which is formed as a cylinder body being part of the translatable body 4.

The loudspeaker is provided with a flexible connection for the translatable body 4 and hence for the diaphragm 8. This flexible connection comprises a first flexible connecting means 18 proximate to the front side 2*a* of the housing 2 and a second flexible connecting means 20 proximate to the rear side 2*b* of the housing 2. The flexible connection is to ensure that the body 4, and particularly the diaphragm 8, can perform well-defined translation movements with respect to the housing 2. The first flexible connection means 18 has a flexible structure formed from, for example, a corrugated rubber annular rim which is secured, for example, glued on its outer circumference to the housing 2 and on its inner circumference to the translatable body 4. The second flexible connection means 20 is formed as an undulating spider of, for example, textile or fabric, wherein the spider is attached to the housing 2 and to the translatable body 4.

In the further description, reference is also made to FIGS. 2 to 4.

In the loudspeaker according to the invention, the housing 2 is provided with a conical forepart 22*a*, a base part 22*b* and a cylindrical intermediate part 22*c*. The conical part 22*a* is positioned near the front side 2*a* of the housing 2 and widens toward the front side 2*a* The base part 22*b* is located near the rear side 2*b* of the housing 2 may be widening towards the rear side 2*b* and may be strengthened by a rib structure $\mathbf{22}b_1$. The base part 22*b* may be provided with mounting means $\mathbf{22}b_2$ for mounting the loudspeaker into a case, e.g. formed by a door of a motor vehicle. The intermediate part 22*c* extends between the forepart 22*a* and the base part 22*b* and has transition areas 22*c*, and $\mathbf{22}c_2$ by means of which it is connected to the part 22*a* and the part 22*b*, respectively. These transition areas $\mathbf{22}c_1$ and $\mathbf{22}c_2$ are dimensioned in such a way that they function as hinges beyond a predetermined axial load (L) acting on the housing 2 and directed in a direction from the one side (2*a* or 2*b*) of the housing 2 to the other side (2*b* or 2*a*) of the housing 2. Such a load may be caused by a forward axial force F acting on the magnet system 6*a* of the actuator 6, while the front side 2*a* of the housing 2 is prevented from moving in the forward axial direction. During hinging, i.e. bending, the transitions $\mathbf{22}c_1$ and $\mathbf{22}c_2$, the forepart 22*a* and the base part 22*b* relatively turn to each other, in addition to which the forepart 22*a* simultaneously moves inwardly, i.e. towards the translation axis 10. These complex movements are demonstrated in FIGS. 3 and 4. As can be derived from FIG. 3, which shows the core in which only a relatively small deformation of the housing has taken place, the transition $\mathbf{22}c_1$ hinges outwardly while the transition $\mathbf{22}c_2$ hinges inwardly. In the situation shown in FIG. 4, further deformation of the transitions $\mathbf{22}c_1$ and $\mathbf{22}c_2$ has taken place, resulting in a considerable reduction of the original height H of the loudspeaker without the risk of causing sharp edges.

The design can be optimized and/or tuned by adapting the value w, i.e. the angle of inclination extending between the forepart 2*a* of the housing 2 and a line parallel to the translation axis 10, the value T, i.e. the thickness of the cylindrical intermediate part 2*c*, and the value L, i.e. the length of the intermediate part 2*c*, to the desired elastic deformation of the housing in relation to a certain load. In this context, it is noted that a certain length L is required in order to create two hinges.

It has been proved that the larger the length L, the easier the forepart of the housing can move inwardly. It has further been proved that the larger the angle w, the smaller the nominal force which is needed for bending the transitions. In other words, the housing of the loudspeaker according to the invention can easily be designed to meet the requirements of the customers. The design is very suitable for simulations, by means of which the desired values of the above-mentioned parameters can be easily determined. The desires of the clients may be various; e.g. a customer might require a deformation of 50% under the influence of an axial force of 3000N, and another customer might require a deformation of 30% in the case of a force of 2500N at an angle of 45° with regard to the translation axis.

If desired by a client, the design can be determined in such a way that the deformations of the transitions may result in a break of a transition.

If suitable, the material of the intermediate part 2*c* can be chosen to be different from the material of the other parts 2*a* and 2*b*.

The invention claimed is:

1. A loudspeaker including a housing with a front side and a rear side, a diaphragm accommodated in and flexibly connected to the housing and an actuator for displacing the diaphragm with respect to the housing along a translation axis imaginarily extending from said one side to said other side of the housing, wherein the housing extends around the translation axis and is provided with a conical forepart widening towards the front side, a base part extending towards the rear side and an intermediate housing part extending between the forepart and the base part and including transition areas connected to the forepart and the base part, which transition areas behave as hinges under the influence of an axial load above a certain value, wherein the intermediate housing portion turns towards the translation axis and the forepart turns towards the rear side under the influence of such a load, and wherein the intermediate housing portion does not break under the influence of such a load.

2. The loudspeaker as claimed in claim 1, wherein the intermediate housing part has a substantially cylindrical shape.

3. The loudspeaker as claimed in claim 1, wherein the material of the intermediate housing part is different from the material of the forepart and/or the base part.

4. The loudspeaker as claimed in claim 1, wherein the transition areas are weaker than the other portions of the housing.

5. The loudspeaker as claimed in claim 1, wherein the forepart of the housing has an angle of inclination, related to a line parallel to the translation axis, which is at least 30 degrees.

6. The loudspeaker as claimed in claim 1, wherein the intermediate housing part has a length dimension, viewed along a line parallel to the translation axis, which is at least 3 mm.

7. The loudspeaker as claimed in claim 1, wherein the intermediate housing part has a thickness dimension, viewed in a direction perpendicular to the translation axis, which is minimally 0.5 mm.

8. A loudspeaker comprising:

a housing having a forepart widening towards a front side, a base part extending towards a rear side, and an intermediate part between the forepart and the base part, the intermediate part being connected to the forepart and the base part by transition areas;

a diaphragm flexibly connected to the housing; and an actuator for displacing the diaphragm with respect to the housing;

wherein the transition areas behave as hinges under a load so that the intermediate part turns towards a central axis of the loudspeaker extending between the forepart and the base part, and wherein the intermediate part does not break under the influence of the load.

9. The loudspeaker of claim 8, wherein the forepart turns towards the base part under the load.

10. The loudspeaker of claim 8, wherein the intermediate part has a substantially cylindrical shape.

11. The loudspeaker of claim 8, wherein the intermediate part is made of different material than the forepart and/or the base part.

12. The loudspeaker of claim 8, wherein the transition areas are weaker than other portions of the housing.

13. The loudspeaker of claim 8, wherein the forepart has an angle of inclination, related to a line parallel to the central axis, which is at least 30 degrees.

14. The loudspeaker of claim 8, wherein the intermediate housing part has a length dimension, viewed along a line parallel to the central axis, which is at least 3 mm.

15. The loudspeaker of claim 8, wherein the intermediate part has a thickness dimension, viewed in a direction perpendicular to the central axis, which is minimally 0.5 mm.

* * * * *